United States Patent [19]

Anspach

[11] 3,961,795

[45] June 8, 1976

[54] ANTITRUST PROSECUTING BOARD GAME

[75] Inventor: Ralph Anspach, Berkeley, Calif.

[73] Assignee: Anti-Monopoly, Inc., San Rafael, Calif.

[22] Filed: Mar. 3, 1975

[21] Appl. No.: 554,687

Related U.S. Application Data

[63] Continuation-in-part of Ser. No. 454,062, March 25, 1974, abandoned.

[52] U.S. Cl. ..... 273/134 AD; 273/134 G; 273/134 B; 273/134 AF; 273/134 C; 273/134 D

[51] Int. Cl.[2] ..... A63F 3/00

[58] Field of Search ..... 273/134

[56] References Cited

UNITED STATES PATENTS 3,759,520 9/1973 Straitwell ..... 273/134 AD 3,850,433 11/1974 Purlia ..... 273/134 AD

*Primary Examiner*—Delbert B. Lowe

*Attorney, Agent, or Firm*—Melvin R. Stidham

[57] ABSTRACT

An antitrust prosecuting game including a game board with a series of spaces forming a continuous path for movement of game pieces. Most of the spaces represent business entities which are grouped by indicia thereon into combinations of three entities. The nature of the combination, i.e., an oligopoly, a trust or a monopoly is indicated by one, two or three indictment circles in the spaces of the group.

3 Claims, 8 Drawing Figures

SOCIAL CREDIT LOAN NOTE $ 350

ELECTRIC (1,2 & 3)

36a

SOCIAL CREDIT LOAN NOTE $ 500

RAILROADS (1,2 & 3)

36b

SOCIAL CREDIT LOAN NOTE $ 700

GAS (1,2 & 3)

36c

30

Antitrust Division
Justice Department

U.S. Postage 8¢

MAIL BOX CARDS

30

A LAWYER HAS BEEN APPOINTED TO HANDLE YOUR CASE. YOU DO NOT HAVE TO GO TO COURT WHEN DIRECTED TO.

*RETURN THIS CARD TO PILE AFTER USING.*

ANTITRUST PROSECUTING BOARD GAME

RELATED APPLICATION

This application is a continuation-in-part of my copending application Ser. No. 454,062 filed Mar. 25, 1974, for "Antitrust Prosecuting Game Board," now abandoned.

BACKGROUND OF THE INVENTION

A number of parlor games involving the exchange and pursuit of play money have as their objects the accumulation of wealth and building of business entity combinations to the detriment of players in competition. Such games originally gained popularity in years of economic depression and provided entertaining diversions from the dismal economic plight many people were actually experiencing. However, there is a belief held by some that games of that sort have an unfortunate side effect in that they tend to teach and emphasize the merits of stifling competition.

OBJECTS OF THE INVENTION

It is an object of this invention to provide a game board, the playing of which has as its object penalizing, rather than rewarding, illegal business entity combinations.

It is a further object of this invention to provide an antitrust prosecuting game board and complementary game pieces.

It is a further object of this invention to provide a game board and complementary game pieces and means on the board for restraining the game pieces against inadvertent displacement.

It is a further object of this invention to provide an antitrust prosecuting game apparatus which has as its objective the termination of the monopolistic practices of plural company combinations.

It is a further object of this invention to provide an antitrust prosecuting game apparatus wherein players, acting as trustbusters, can file indictments against members of an illegal combination and earn rewards for progressive levels of success in their trustbusting activities.

Other objects and advantages of this invention will become apparent from the description to follow when read in conjunction with the accompanying drawings.

BRIEF SUMMARY OF THE INVENTION

In carrying out this invention, there is provided a game board having a series of spaces forming a continuous path along which a game piece may be moved in increments determined by indicator means, such as conventional dice. Each of the spaces represent a business entity and the businesses are grouped, though not necessarily in juxtaposition, as unlawful combinations, usually engaged in a common industry or utility. Some indicia, such as a color code, is used to identify and group the companies of such combinations. Within all spaces of a particular combination are delineated areas, the number of which identify the nature and degree of the unlawful combinations, e.g., an oligopoly, a trust or a monopoly. This, in turn, indicates the extent of legal action, i.e., the number of legal steps measured by placement of a player's indictment chips in the spaces representing the companies of a combination, required to win the case against the combination. For example, in the preferred embodiment of this invention, a single procedure levied against each of the three companies of an oligopoly will win the case against the combination; two procedures against each company will terminate a trust; and three legal steps taken against each company will terminate a monopoly. By the same token, the greater the evil, the greater the reward for success in defeating it. Accordingly, trustbusting bonuses and other rewards accrue to a successful trustbuster in increasing amounts, depending upon the nature of the unlawful combination successfully prosecuted. On the other hand, penalties are assessed against trustbusters for inefficient activities. In addition to the dice, player pieces and play money, the game apparatus includes post card directions, player-coded indictment chips and several credit loan notes to evidence advances made by a Budget Director to trustbusters against anticipated success.

DESCRIPTION OF A PREFERRED EMBODIMENT

Figure 1:
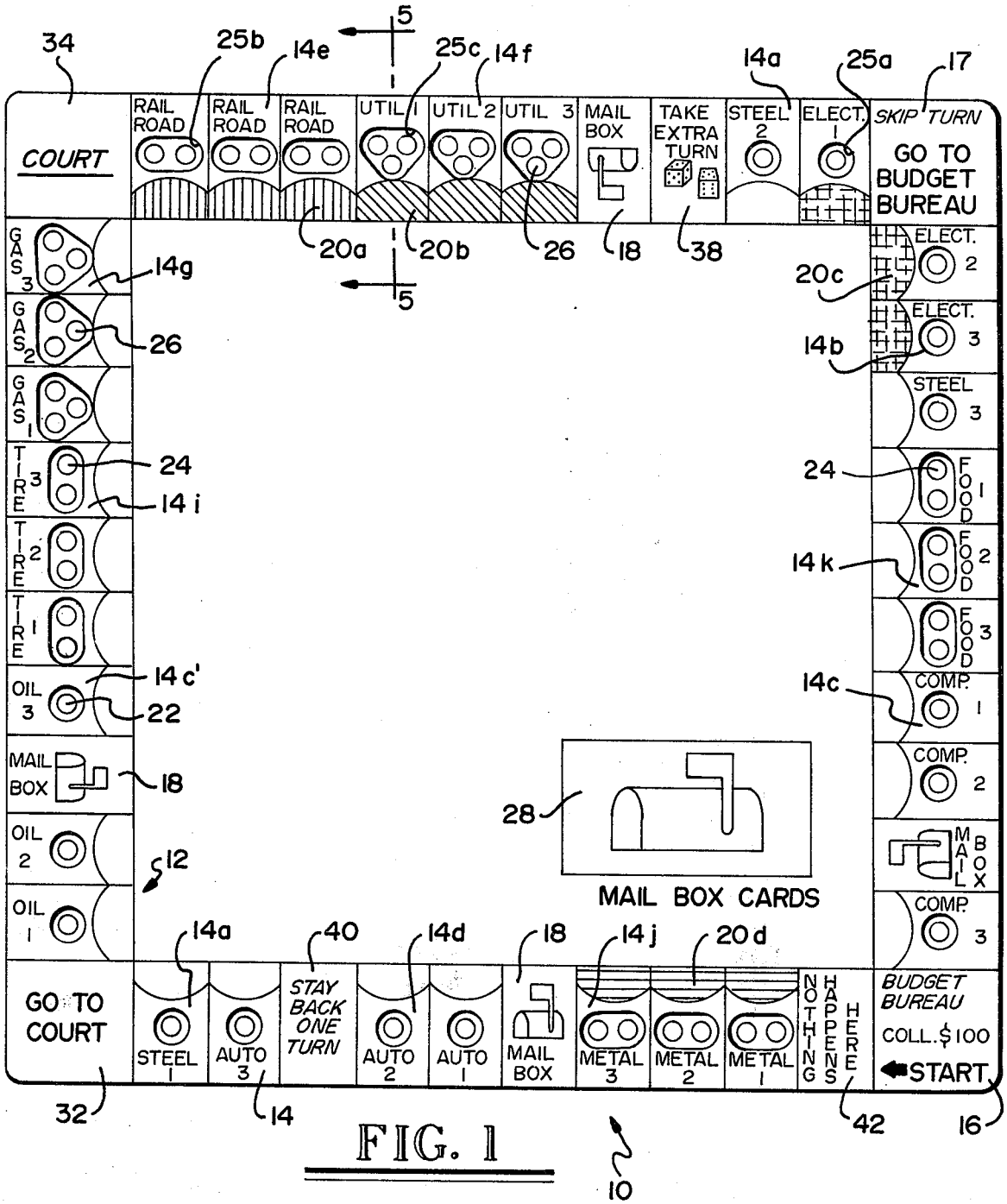
FIG. 1 is a top plan view of the playing board for use in the antitrust prosecuting game of this invention.

Referring now to FIG. 1 with greater particularity, the game board 10 of this invention has delineated thereon a peripheral track 12 comprising a plurality of spaces 14*a*, 14*b*, 14*c*, etc., forming a continuous path from a corner starting square 16 around the board.

Most of the track spaces represent business entities and the business entities are grouped, although not necessarily in juxtaposition, in accordance with the industry of which they are a part. For example, there are three steel companies 14*a*, at widely scattered places on the board; there are three electrical appliance manufacturers 14*b*, three oil companies 14*c'*, three computer manufacturers 14*c*, and three automobile manufacturers 14*d*, some with a mail box space 18 or other directive space 17 (Go to Budget Bureau) separating individual companies of the combination; and there are combinations of railroads 14*e*, utilities 14*f*, gas companies 14*g*, tire companies 14*i*, metal producers 14*j*, and food processing companies 14*k*, the component companies of which are all grouped together on the board. In every case, the spaces are marked with some indicia to indicate that the three companies of any combination are grouped. As shown, the companies of a group may be designated by the nature of the business in which they are active, e.g., Steel 1, Steel 2, and Steel 3, or the companies of a group may be given a fictitious name, and a like colored code area 20*a*, 20*b*, etc., applied to the company spaces in the combination.

Figures 2A, 2B, 2C, 3A, 3B, 4:
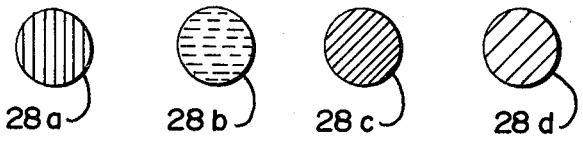
FIGS. 2A–2C show social credit loan notes to evidence loans advanced to a trustbuster.
FIGS. 3A and 3B show a specimen mail box card.
FIG. 4 shows a plurality of indictment chips.

Each company of a combination has a second code marking to indicate the nature of the combination. For example, certain companies may have a single internal marking 22 as, for example, a circle to show that the combination is an oligopoly; others have a double marking 24 to show that the combination is a trust; and two of the combinations, i.e., the utilities and the gas companies have a triple marking 26 to indicate that the companies therein comprise a monopoly. Conveniently, the markings 22, 24 and 26 may function as indictment circles to be covered by color coded indictment chips 28*a*, 28*b*, . . . (FIG. 4), there being a plurality in each color corresponding to that of a player's movable game pieces (not shown) whereby a player whose game piece lands on a particular company space 14 *a-k* which is unoccupied by a marker may purchase one of his indictment chips 28 if he desires and place it on an indictment circle 22, 24 or 26.

Figure 5:
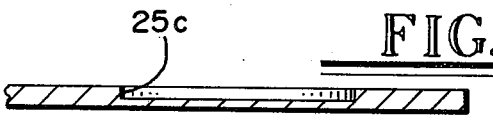
FIG. 5 is a sectional 21 view taken along line 5–5 of FIG. 1.

Preferably, the game board is recessed at 25*a*, 25*b* and 25*c* around the single circle 22, double circle 24 and triple circle 26 (FIG. 5) to function as a restraining enclosure to prevent displacement of the indictment chips 28, once placed on a company space 14 *a-k*.

A combination is deemed to be assigned to a particular player for prosecution as his case when his indictment chips 28 occupy one indictment circle on two of the three companies of a combination, and the combination is deemed terminated when the player's indictment chips occupy all of the indictment circles of the combination. If the movement of the game pieces, as determined for example by conventional dice, makes it impossible for any one trustbuster to occupy one indictment circle on two of the three companies of a combination an impasse, called a stand-off, ensues. The impasse is resolved either by dice-tossing or by voluntary exchanges between trustbusters called interchanges.

In addition to the spaces identifying business entities there are a plurality of spaces 18 designated "Mail box" which directs a player to the mail box 28 to pick the uppermost card 30 (FIG. 3) therefrom and to follow the directions thereon.

One of the corner spaces directs the player who lands thereon to go to the Budget Bureau whereupon he may move to the corner space 16 to collect $100, and another corner space 32 directs the player who lands thereon to go to court, whereupon he moves to the corner space 34, where he may suffer an inconvenience, as will be explained.

Playing the Game

Before commencing the game, one player is selected as the Budget Director, whose duties include collecting monies paid to, and issuing monies from, the budget; and issuing Social Credit Loan Note 36 (FIG. 2). Each player is given a budget allocation of a stipulated sum of money. For example, for a less demanding game, each player may be allotted $1,500.00 in play money (not shown) comprising one $500, seven $100.00 notes, and six $50.00 notes. For a more demanding game requiring more deliberation and prudence in determining whether or not to purchase an indictment, the players may start with a budget allocation of (one $500 note, three S100 notes and four $50 notes).

The player to roll first is determined by rolling the dice with the highest thrower to have his choice of matching color for game piece (not shown) and indictment chips 28. Play proceeds clockwise around the board, each player choosing his color in turn. When a trustbuster lands on a company space 14*a*–14*k*, he may bring one $100 indictment against it, although he does not have to. If he elects to do so, he purchases a $100 indictment chip of his own color from the Budget Director and places it on the open circle on the company space on which he has landed. Except as otherwise provided here, only one indictment chip may be purchased per roll of the dice.

When a trustbuster has issued at least one $100 indictment against any two of the three companies of a combination, that combination becomes his assigned case. Accordingly, any indictments which were previously served against a company of that combination by one or more of the other trustbusters are removed from the board and returned to the Budget Director, who pays the ousted trustbuster only $50. At this time the trustbuster to whom the case has been assigned may replace those indictment chips which have been removed with indictment chips 28 of his own, playing the usual $100 therefor.

If it is impossible to assign a case to one trustbuster, because all of the indictment circles are divided equally among the players, as, for example, when the indictment chips of each of three players occupy the three indictment circles of an oligopoly, the players may roll the dice to see who gets the assigned case. After the case is assigned in this matter, removal and replacement of indictment chips then proceed as when a case is assigned.

A trustbuster who lands on a company of a combination which has been assigned to another trustbuster must pay a fine to the Budget Director, because he has wasted funds on a case previously assigned to another trustbuster. In accordance with the preferred rules, the fines are set at $50 for an oligopoly, $100 for a trust, and $150 for a monopoly.

A case is successfully completed against a combination, i.e., it is trustbusted, when all the indictment circles of the combination are covered by a player's indictment chips, indicating that he has successfully enjoined the monopolistic practices of the combination through court action. When the trustbuster succeeds in his fight against a combination, he is rewarded with a financial bonus from the Budget Director in the amounts of $300 for an oligopoly, $500 for a trust and $700 for a monopoly. In addition, if another trustbuster lands on a trustbusted combination which has all indictment circles covered, he must make a payment to the successful trustbuster to enable him to continue supervision of the reformed company. Such supervisory payments to be paid by intruding trustbusters are $150 for an oligopoly, $250 for a trust and $400 for a monopoly.

Players also earn social credit points for different levels of success in their trustbusting activities. Such social credits are earned as follows:

If the combination assigned to the trustbuster is an oligopoly, he earns social credits of 450 points if the indictment circle or circles of each company is occupied by his indictment chips.

If the combination assigned to him is a trust, he earns social credits of 450 points if one indictment circle of each company is occupied by his indictment chips; and he earns social credits of 1,000 points if both indictment circles of each company are occupied by his indictment chips.

If the combination assigned to him is a monopoly, he earns social credits of 450 points if one indictment circle of each company is occupied by his indictment chips; he earns social credits of 1,000 points if two indictment circles of each company are occupied by his indictment chips; and he earns social credits of 1750 points if all three indictment circles of each company are occupied by his indictment chips.

The earning of social credit points does not involve the passage of money but is merely evidenced by the indictment chips on the assigned case against which money may be borrowed.

When a player runs out of money, he may obtain a social credit advance from the Budget Director, provided he already has a case assigned to him. Such social credit loans are based on the social credits the trustbuster could earn if he were able to bring his case to a successful conclusion. Hence, if a trustbuster has an oligopoly assigned to him, he may borrow $350; if a trust has been assigned to him he may borrow $500; and if a monopoly has been assigned to him he may borrow $700. When such loans are made, the Budget Director issues him a Social Credit Loan Note 36*a*, 36*b*, 36*c*, . . . (FIG. 2) to the amount of the advance. As indicated in FIG. 2, there is a Social Credit Loan Note for each combination on the board 10 and only one loan is permitted per assigned case. At the end of the game, the total value of these notes held by a player is deducted from the player's social credit score as evidenced by his indictment chips.

In addition to the normal prosecution of unlawful combinations, the players are also required to follow extraneous instructions from time to time. For example, the game board 10 also includes spaces 18 which direct the players who land on them to the mail box 28 where he takes the uppermost postcard 30 on a stack thereof. A specimen postcard message is shown in FIG. 3. The following is a sampling of other messages:

Your office has been penalized for improper procedures. TRANSMIT $50 to the budgets of all other trustbusters.

You have been transferred to another case because of your fine work. ROLL THE DICE AND MOVE AHEAD. Collect from the Budget Director whatever payment is called for on that space. If there is no payment, the transfer is no improvement.

Due to political pressure, your Antitrust work has been damaged. REMOVE ANY ONE OF YOUR INDICTMENT CHIPS FROM THE BOARD.

A new budget appropriation has been passed by Congress. COLLECT $100.

COURT DECISION:

The Supreme Court has ruled that lowering prices in order to destroy competitors is a predatory monopolistic practice. You may add an indictment any place you wish without payment.

As previously mentioned, a player collects $100 when he lands on the Budget Bureau corner space 16 and another corner space 17 sends him to the Budget Bureau. In addition, there is a corner space 32 directing a trustbuster to Court, which is another corner space 34. In accordance with the rules, leaving Court 34 is no problem, provided the player does not roll doubles on the dice. However, should he roll doubles he is found in contempt for duplicity and must remain in Court until his next turn in order to hear the judge's verdict.

In addition to the mailbox spaces 18 and the corner spaces 16, 17, 32, and 34, there is a space 38 that gives the player another turn; there is a space forty-two that gives the player nothing at all, good or bad.

The game ends when any one player runs out of money and has exhausted his borrowing possibilities. At this point, the players count their money; subtract the amounts of loan notes 36*a*, 36*b*, etc., from social credits earned; and the player with the highest total wins.

While this invention has been described in conjunction with a preferred embodiment thereof, it is obvious that modifications and changes therein may be made by those skilled in the art without departing from the spirit and scope of this invention.

What is claimed as invention is:

1. Antitrust prosecuting game apparatus comprising:

a game board;

a track on said game board having a series of spaces forming a continuous path along which a game piece is movable in increments determined by indicator means;

each of certain of said track spaces representing a business entity;

a plurality of first indicia areas of different colors on said certain track spaces, each of said first indicia color appearing on at least two of said certain track spaces to group said spaces to represent unlawful business entity combinations;

a plurality of indictment chips in groups of different colors, a group for each player available for purchase by said player to serve on a business entity space on which his game piece lands;

indictment areas delineated on each of said certain track spaces for placement of indictment chips thereon, with the number of said indictment areas on all spaces of a group thereof representing a business combination being the same to identify the nature of said combination and the numbers of indictment areas differing between groups in accordance with the types of unlawful business combinations represented thereby.

2. The game apparatus defined by claim 1 including:

means on said game board surrounding said indictment areas for confining one or more indictment chips placed thereon.

3. The game apparatus defined by claim 1 including:

depressed areas on said game board surrounding the indictment areas on each of said certain track spaces to confine indictment chips placed thereon.

* * * * *